US011085353B2

(12) United States Patent
Scharp

(10) Patent No.: US 11,085,353 B2
(45) Date of Patent: Aug. 10, 2021

(54) OIL SUPPLY ELEMENT AND PISTON OF AN INTERNAL COMBUSTION ENGINE

(71) Applicant: Mahle International GmbH, Stuttgart (DE)

(72) Inventor: Rainer Scharp, Vaihingen (DE)

(73) Assignee: Mahle International GmbH

( * ) Notice: Subject to any disclaimer, the term of this patent is extended or adjusted under 35 U.S.C. 154(b) by 0 days.

(21) Appl. No.: 16/691,586

(22) Filed: Nov. 21, 2019

(65) Prior Publication Data

US 2020/0165957 A1 May 28, 2020

(30) Foreign Application Priority Data

Nov. 23, 2018 (DE) ..... 10 2018 220 193.5

(51) Int. Cl.
*F01P 3/06* (2006.01)
*F01P 3/10* (2006.01)
*F01P 3/00* (2006.01)

(52) U.S. Cl.
CPC . *F01P 3/10* (2013.01); *F01P 3/06* (2013.01); *F01P 2003/006* (2013.01)

(58) Field of Classification Search
CPC F01P 3/10; F01P 2003/006; F01P 3/06; F01P 3/08
See application file for complete search history.

(56) References Cited

U.S. PATENT DOCUMENTS

| | | | | |
|---|---|---|---|---|
| 7,409,903 | B2 * | 8/2008 | Scharp | F02F 3/22 92/186 |
| 9,341,137 | B2 | 5/2016 | Leitl | |
| 9,951,715 | B2 | 4/2018 | Scharp | |
| 10,260,452 | B2 | 4/2019 | Linke et al. | |
| 2014/0130767 | A1 * | 5/2014 | Leitl | F02F 3/22 123/193.6 |

FOREIGN PATENT DOCUMENTS

| | | | |
|---|---|---|---|
| DE | 37 32 927 | A1 | 4/1989 |
| DE | 103 46 819 | A1 | 4/2005 |
| DE | 10 2011 106 379 | A1 | 1/2013 |
| DE | 10 2013 013 962 | A1 | 2/2015 |
| DE | 10 2014 005 364 | A1 | 10/2015 |
| DE | 10 2016 221 353 | A1 | 5/2018 |
| JP | H11-132101 | A | 5/1999 |

OTHER PUBLICATIONS

English abstract for JP-H11-132101.
English abstract for DE-Eng. abstract DE-37 32 927.
English abstract for DE-10 2016 221 353.

* cited by examiner

*Primary Examiner* — Jacob M Amick
(74) *Attorney, Agent, or Firm* — Fishman Stewart PLLC

(57) ABSTRACT

An oil supply element for supplying oil into a cooling channel of a piston in an internal combustion engine, may include a channel having a lateral opening with an oil discharge element and may be configured to direct a partial oil flow via the oil discharge element and the lateral opening to at least one of an underside of a piston crown, a hub, and a piston interior.

20 Claims, 1 Drawing Sheet

OIL SUPPLY ELEMENT AND PISTON OF AN INTERNAL COMBUSTION ENGINE

CROSS-REFERENCE TO RELATED APPLICATIONS

This application claims priority to German Patent Application No. DE 10 2018 220 193.5, filed on Nov. 23, 2018, the contents of which are hereby incorporated by reference in their entirety.

TECHNICAL FIELD

The present invention relates to an oil supply element for supplying oil into a cooling channel of a piston in an internal combustion engine. The invention further relates to a piston having a cooling channel and an oil supply element of this kind and also an internal combustion engine having at least one piston of this kind.

BACKGROUND

The cooling of a piston in an internal combustion engine customarily takes place via a cooling channel which is configured either as a closed cooling channel or as an open cooling channel. If it is configured as an open cooling channel, oil is customarily injected into an oil intake port from below and then distributed in the circumferential direction in the cooling channel. The oil absorbs heat during this process and cools the piston. A cooling channel of this kind is customarily ring-shaped in design and arranged between an outer ring section and an edge of a combustion recess. However, the combustion recess further comprises the so-called piston crown which is also to be cooled. In the case of pistons known from the prior art, this may involve division of a jet of cooling oil, for example.

DE 10 2013 013 962 A1 discloses a structural unit comprising a piston and an injection nozzle for cooling oil, wherein the piston has a piston head and a piston shaft. The piston head has a piston crown with an underside, a circumferential ring section and a circumferential cooling channel in the region of the ring section with at least one supply opening for cooling oil. An injection nozzle is arranged below the piston shaft and supplies cooling oil to the piston. So that cooling of the underside of the piston crown can also be achieved, in addition to an injection of cooling oil into the cooling channel, the piston has a jet splitter for cooling oil on the underside of the piston crown adjacent to the at least one supply opening for cooling oil, which jet splitter is injected with cooling oil by the injection nozzle. Depending on the position of the piston between the upper and lower dead centre, the cooling oil jet is differently divided between the underside and the cooling channel during this process.

DE 10 2014 005 364 A1 likewise discloses a structural unit with a piston and an oil injection nozzle for cooling oil, wherein the piston in turn has a circumferential cooling channel with at least one supply opening for cooling oil. So that cooling oil can be injected both into the cooling channel and also onto the underside of the piston crown in this case, two oil injection nozzles are provided. In this way, increased cooling of the underside of the piston crown should be achieved in particular.

The disadvantage of the solutions known from the prior art is, however, that a division of the cooling oil jet into a cooling oil jet entering the cooling channel and a partial oil jet reaching the underside of the piston crown cannot be quantified, or only with some difficulty. So that there need never be any concerns about an insufficient supply, more oil is usually injected than is necessary; however this requires greater pump capacity and increases fuel consumption.

SUMMARY

The present invention also deals with the problem of specifying an improved or at least alternative embodiment for an oil supply element of the generic kind which particularly overcomes the disadvantages known from the prior art.

This problem is solved according to the invention by the subject matter of the independent claim(s). Advantageous embodiments are the subject matter of the dependent claim (s).

The present invention is based on the general principle of achieving a reliable and, at the same time, quantifiable division of a cooling oil jet into a partial cooling oil jet entering a cooling channel of a piston and a partial cooling oil jet injected onto an underside of a piston crown, a hub or an interior of the piston, which division is no longer achieved by means of two different oil injection nozzles or a jet splitter integrated in the piston, for example, but by a specially designed oil supply element. The oil supply element according to the invention for supplying oil into the cooling channel of the piston in an internal combustion engine has a channel in this case for supplying oil into the cooling channel of the piston, wherein a lateral opening with an oil discharge element is provided in this channel, so that a partial oil flow can be directed via the oil discharge element and the lateral opening to an underside of the piston crown, the hub or the interior of the piston. The oil supply element according to the invention therefore allows a hitherto necessary second oil injection nozzle for spraying the underside of the piston crown to be dispensed with in the same way as a jet splitter integrated in the piston itself. An oil supply element of this kind can be produced cost-effectively in this case and combined with virtually all types of piston with corresponding cooling channels.

In an advantageous development of the solution according to the invention, the oil supply element has an inlet funnel. A funnel shape of this kind or also a trumpet shape allows improved capture of a cooling oil jet and at the same time brings about a concentration and therefore also a steady flow of the oil jet in the narrowing cross section. In a preferred embodiment, the channel cross section is preferably almost completely filled with cooling oil, at least in a portion directly in front of the oil discharge element, so that an accurately defined partial quantity of oil is discharged. In this way, it is particularly possible for the partial oil flow discharged via the oil discharge element to be capable of being determined more accurately, particularly with regard to quantity and flow speed. By means of an inlet funnel of this kind, production tolerances and alignment tolerances of an oil injection nozzle can also be compensated for.

In an advantageous development of the solution according to the invention, the oil supply element has a diameter $d_1$ of approx. 4 mm in the region of the channel and a diameter $d_2$ of approx. 10 mm in the inlet region, in other words in the region of the inlet funnel. In this way, a particularly optimized flow can be forced in the channel or also via the oil discharge element to the piston crown, the hub or the inside of the piston. It would be particularly advantageous in this case for an oil quantity required for the reliable cooling of the piston to be capable of being reduced by the inlet funnel and the cross section of the oil supply element which diminishes in the direction of the cooling channel, as a result of which an oil pump output required for this purpose and a fuel consumption at least indirectly associated with this can be reduced.

In an advantageous development of the solution according to the invention, the oil supply element is configured as an integral sheet-metal formed part, as a result of which the oil supply element can not only be produced cost-effectively, but also to a high standard of quality. A sheet-metal element of this kind may, for example, be initially stamped out of planar sheet-metal strip and then formed. The two ends of the oil supply element formed in a ring shape may be adhered, soldered or welded to one another in this case or connected in some other way. Purely theoretically, it is even conceivable for the two edges not to be connected to one another, in which case a diameter of the channel of the oil supply element may be at least slightly larger than an oil supply opening in the cooling channel, so that by compressing the oil supply element it can be inserted into the oil supply opening of the cooling channel and then clamped therein by releasing. This represents a particularly cost-effective way of fixing the oil supply element.

In a further advantageous embodiment of the solution according to the invention, the oil discharge element is configured as an inwardly pressed open pocket. An inwardly pressed, open pocket of this kind can be manufactured comparatively simply and yet extremely precisely in production terms. It may, by way of example, be co-produced after stamping out the oil supply element configured as a sheet-metal formed part during subsequent forming.

The present invention is further based on the general principle of fitting a piston with a cooling channel and a piston crown with an oil supply element of this kind and arranging this in such a manner that oil injected into the oil supply element by means of an oil supply nozzle is partially directed into the cooling channel and partially to the underside of the piston crown, the hub or the piston interior. A main oil flow in this case preferably passes through the channel to reach the cooling channel, while a partial oil flow is discharged from the channel via the oil discharge element and conveyed to the underside of the piston crown, the hub and/or the piston interior. By means of a piston of this kind, reliable cooling thereof can be achieved with a simultaneous reduction in the quantity of oil conveyed. In this way, a fuel consumption of an internal combustion engine fitted with a piston of this kind can, in particular, be reduced.

A cooling channel cover is advantageously provided to which the oil supply element is fastened. The cooling channel in the case of the piston may, for example, be configured as a cooling channel that is open downwardly, in other words towards a shaft, which is covered by means of a corresponding cooling channel cover. A cooling channel cover of this kind is configured as a partial circular segment for example. Using corresponding wings which are arranged on the oil supply element, for example, said oil supply element can be clipped to two edges of two adjacent cooling channel covers. Alternatively, it is also of course also conceivable for the cooling channel to have an inlet bore or a supply opening and to be otherwise closed by piston material, wherein in this case the oil supply element projects into the inlet bore and is connected to the piston in the region of said bore or in the region of a shaft wall, in particular fixed thereto. The cooling channel of course also has a discharge bore or a discharge opening in this case. Fastening the oil supply element in the inlet bore may, for example, also be achieved by spring-clamping the same or, alternatively, also by adhesion, soldering or welding.

The present invention is further based on the general principle of equipping an internal combustion engine with a piston as described in the previous paragraphs, wherein this internal combustion engine has an oil injection nozzle which injects oil into the oil supply element and thereby reliably cools an associated piston both in the region of a cooling channel and also in the region of the underside of the piston crown, the hub and/or the piston interior.

Further important features and advantages of the invention result from the dependent claims, from the drawings and from the associated figure description with the help of the drawings.

It is evident that the features referred to above and those yet to be explained below can not only be used in the combination specified in each case, but also in other combinations or in isolation, without departing from the framework of the present invention.

Preferred exemplary embodiments of the invention are shown in the drawings and are explained in greater detail in the following description, wherein the same reference numbers relate to the same or similar or functionally identical components.

BRIEF DESCRIPTION OF THE DRAWINGS

Shown schematically in each case are.

DETAILED DESCRIPTION

Figure 1:
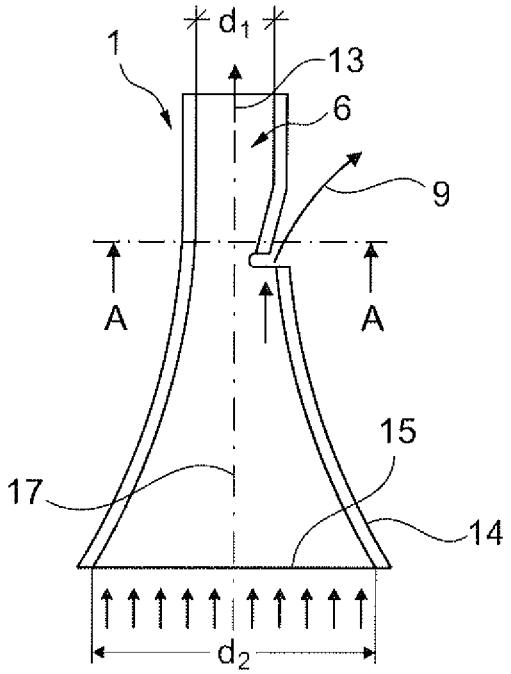
FIG. 1 shows a sectional representation through an oil supply element according to the invention.
Figure 3:
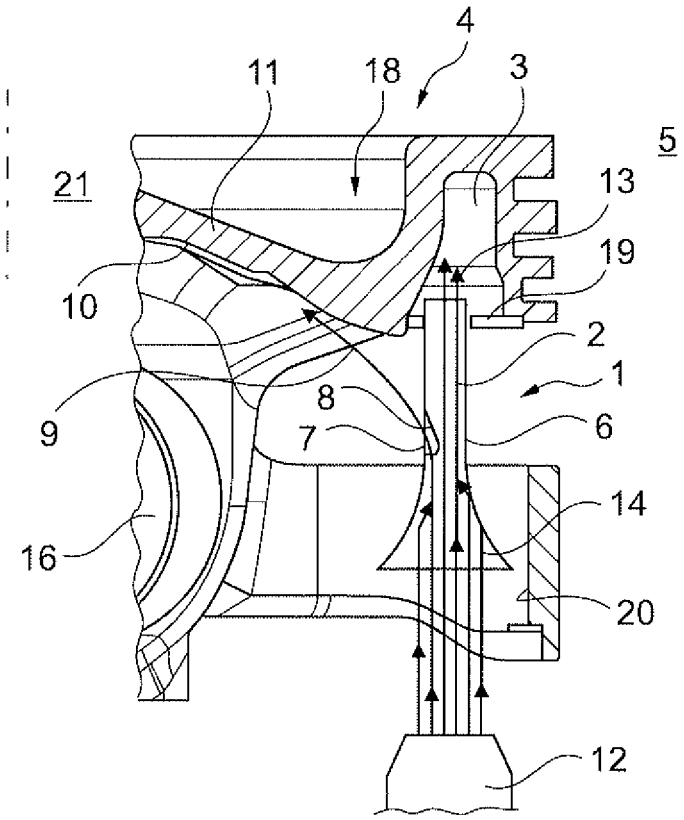
FIG. 3 shows a sectional representation through a piston according to the invention with an oil supply element of this kind.

In accordance with FIGS. 1 and 3, an oil supply element 1 according to the invention for supplying oil 2 into a cooling channel 3 of a piston 4 of an internal combustion engine 5 comprises a channel 6 for supplying oil 2 into the cooling channel 3, wherein a lateral opening 7 is provided in this channel 6 with a discharge element 8, so that a partial oil jet 9 can be directed via the oil discharge element 8 and the lateral opening 7 to an underside 10 of a piston crown 11, a hub 16 and/or a piston interior 21 of the piston 4. Using the oil supply element 1 according to the invention, it is therefore possible for the first time, without providing two separate oil injection nozzles 12 or a jet splitter directly attached to the piston 4, for the oil 2 to be divided into a partial oil jet 9 cooling the piston crown 11 and an oil jet 13 entering the cooling channel 3.

According to FIG. 3, the oil supply element 1 is depicted in greatly magnified form to provide greater clarity. The oil supply element 1 preferably has an intake funnel 14 which provides the oil supply element 1 with a funnel-shaped or trumpet-shaped form. In the region of the channel 6 the oil supply element 1 in this case has a diameter $d_1$ of approx. 4 mm, while a diameter $d_2$ in an inlet region 15, in other words at a free end of the inlet funnel 14, has a diameter $d_2$ of approx. 10 mm. In this way, a substantially improved capture of oil 2 is possible, so that production tolerances can also be compensated for comparatively easily. The oil supply element 1 is preferably configured as an integral sheet-metal formed part and can thereby be produced cost-effectively, for example by stamping out a corresponding shape with subsequent rolling or forming into the funnel shape.

The partial oil jet 9 in this case may, additionally or alternatively, serve to cool the hub 16 or an inner form of the piston 4 in general. By comparison with a jet splitter which is formed integrally with the piston 4, for example, the oil supply element 1 according to the invention additionally offers the huge advantage that a substantially more precise quantification and also determination of the dischargeable partial oil flow 9 is possible, as a result of which the surplus quantity of oil required hitherto on account of such inaccuracies can be reduced, which leads to a reduction in the pump capacity of an oil pump and therefore also to a reduction in fuel consumption of the internal combustion engine 5.

Figure 2:
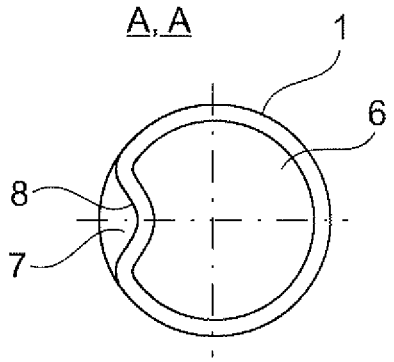
FIG. 2 shows a sectional representation through the oil supply element according to the invention along the plane of intersection A-A.

A closer look at the oil discharge element 8, particularly according to FIG. 2, reveals that it is configured as an inwardly pressed, open pocket which is open towards the intake funnel 14. A pocket of this kind can be produced comparatively easily, as a cut perpendicular to the axis 17 of the oil supply element 1 on the lateral surface thereof need only initially be introduced into the channel 6 and then the pocket, in other words the oil discharge element 8, is pressed in. Also extremely advantageous in the case of the oil supply element 1 according to the invention is that it can also be used with pistons known hitherto from the prior art without requiring substantial modification.

The piston 4 depicted in FIG. 3 is part of the internal combustion engine 5 and has the cooling channel 3 running between an outside ring section and a combustion recess 18. This is covered downwardly by means of a cooling channel cover 19, wherein the oil supply element 1 is arranged on the cooling channel cover 19, particularly in the region of an oil supply opening of the same. Fastening the oil supply element 1 to the cooling channel cover 19 may take place by adhesion, caulking, clamping, soldering or welding, for example. It is of course also conceivable from a purely theoretical standpoint, for the oil supply element 1 to be attached via a corresponding lug which is not shown to the piston 4 itself, for example to a shaft wall 20 thereof.

Overall, with the oil supply element 1 according to the invention and a piston 4 fitted therewith, substantially improved cooling can take place, for example of a hub 16 or an underside 10 of the piston crown 11, particularly also by means of reduced resources, as the oil discharge element 8 according to the invention means that the partial oil flow 9 that is discharged out of the oil supply element 1 can be quantified extremely accurately. Provision of a surplus quantity, as was hitherto necessary, is therefore no longer required.

The invention claimed is:

1. An oil supply element for supplying oil into a cooling channel of a piston in an internal combustion engine, comprising:

a body defining a channel having a lateral opening;

the body including an elongated, circumferentially extending slit that defines the lateral opening of the channel; and the body further including an oil discharge element configured to direct a partial oil flow and through the lateral opening to at least one of an underside of a piston crown, a hub, and a piston interior.

2. The oil supply element according to claim 1, wherein the body includes a flared portion defining an inlet funnel.

3. The oil supply element according to claim 2, wherein the body has a diameter of approximately 4 mm in a region of the channel and a diameter of approximately 10 mm at the inlet funnel.

4. The oil supply element according to claim 1, wherein the body is structured as an integral sheet-metal part.

5. The oil supply element according to claim 1, wherein the oil discharge element projects from the body into the channel and is structured as an inwardly pressed pocket.

6. A piston, comprising:

a cooling channel;

a combustion recess;

a piston skirt extending around and at least partially defining a piston interior;

a piston crown disposed between and separating the combustion recess from the piston interior;

a hub disposed in the piston skirt; and an oil supply element including a channel having a lateral opening with an oil discharge element, the oil supply element configured to direct a partial oil flow via the oil discharge element and the lateral opening to at least one of an underside of the piston crown, the hub, and the piston interior;

wherein the oil supply element is arranged such that oil injected into the oil supply element is partially directed into the cooling channel and partially directed to at least one of the underside of the piston crown, the hub, and the piston interior.

7. The piston according to claim 6, further comprising a cooling channel cover, wherein the oil supply element is coupled to the cooling channel cover.

8. The piston according to claim 6, wherein the cooling channel includes at least one of an inlet bore and a supply opening into which the oil supply element projects, wherein the oil supply element is connected in at least one of (i) a region of the at least one of the inlet bore and the supply opening and (ii) in a region of a shaft wall of the piston.

9. An internal combustion engine, comprising:

an oil injection nozzle; and a piston including:

a cooling channel;

a combustion recess;

a piston skirt extending around and at least partially defining a piston interior;

a piston crown disposed between and separating the combustion recess from the piston interior;

a hub disposed in the piston skirt; and an oil supply element including a channel having a lateral opening with an oil discharge element, the oil supply element configured to direct a partial oil flow via the oil discharge element and the lateral opening to at least one of an underside of the piston crown, the hub, and the piston interior;

wherein the oil supply element is arranged such that oil injected into the oil supply element is partially directed into the cooling channel and partially directed to at least one of the underside of the piston crown, the hub, and the piston interior; and wherein the oil injection nozzle is structured and arranged to inject oil into the oil supply element.

10. The internal combustion engine according to claim 9, wherein the oil supply element further includes an inlet funnel.

11. The oil supply element according to claim 1, wherein:

the body further includes a tubular wall defining the channel;

the tubular wall includes a bent portion that projects into the channel; and the oil discharge element is defined by the bent portion of the tubular wall.

12. The oil supply element according to claim 11, wherein the body is structured as a sheet-metal body.

13. The oil supply element according to claim 11, wherein a first end of the body is structured as an intake funnel having a larger diameter than a second end of the body disposed opposite the first end.

14. The oil supply element according to claim 13, further comprising a plurality of wings configured to engage a cooling channel cover, wherein the plurality of wings are disposed on the body between the lateral opening and the second end of the body.

15. The oil supply element according to claim 13, wherein a distance the oil discharge element protrudes into the channel decreases in a direction extending from the first end of the body to the second end of the body.

16. The oil supply element according to claim 1, wherein the body further includes:

a tubular portion that delimits the channel; and a pressed-in portion that projects from the tubular portion into the channel and defines the oil discharge element.

17. The oil supply element according to claim 1, wherein:

the body further includes a tubular wall delimiting the channel;

the slit is disposed in the tubular wall;

a portion of the tubular wall that defines an edge of the slit is bent inwardly and projects into the channel; and the oil discharge element is defined by the bent portion of the tubular wall.

18. The oil supply element according to claim 1, further comprising a plurality of wings disposed on the body and configured to engage a cooling channel cover.

19. The piston according to claim 6, wherein:

a portion of the oil supply element is disposed within the cooling channel and another portion of the oil supply element is disposed within the piston interior; and the lateral opening of the oil supply element is disposed in the piston interior.

20. The piston according to claim 6, further comprising a cooling channel cover, wherein:

the cooling channel opens into the piston interior;

the cooling channel cover is disposed between the cooling channel and the piston interior and closes the cooling channel; and the oil supply element includes a plurality of wings via which the oil supply element is coupled to the cooling channel cover.

* * * * *